United States Patent [19]

Smith

[11] Patent Number: 4,530,232

[45] Date of Patent: Jul. 23, 1985

[54] FRAME AND BODY REPAIR APPARATUS

[75] Inventor: John W. Smith, Kimball, Minn.

[73] Assignee: Systems International, Inc., Hutchinson, Minn.

[21] Appl. No.: 590,519

[22] Filed: Mar. 16, 1984

[51] Int. Cl.[3] ..... B21D 1/12

[52] U.S. Cl. ..... 72/447; 72/705

[58] Field of Search ..... 72/447, 705

[56] References Cited

U.S. PATENT DOCUMENTS

| | | | |
|---|---|---|---|
| 2,563,527 | 8/1951 | Gingrich et al. . | |
| 2,674,293 | 4/1954 | Elam . | |
| 2,705,040 | 3/1955 | Howick . | |
| 2,792,046 | 5/1957 | Fagan . | |
| 3,088,513 | 5/1963 | Marquardt . | |
| 3,340,720 | 9/1967 | Chartier . | |
| 3,518,867 | 7/1970 | Rouis . | |
| 3,566,667 | 3/1971 | Hagerty | 72/705 |
| 3,581,547 | 6/1971 | Estigarribia . | |
| 3,612,482 | 10/1971 | Eck | 72/705 |
| 3,626,747 | 12/1971 | Rouis . | |
| 3,630,066 | 12/1971 | Chisum . | |
| 3,729,978 | 5/1973 | Lunardini . | |
| 3,888,100 | 6/1975 | Chisum . | |
| 4,138,877 | 2/1979 | Specktor . | |
| 4,151,737 | 5/1979 | Specktor . | |
| 4,236,400 | 12/1980 | Specktor . | |
| 4,248,079 | 2/1981 | Specktor . | |
| 4,296,624 | 10/1981 | Specktor . | |

*Primary Examiner*—Lowell A. Larson

*Attorney, Agent, or Firm*—Burd, Bartz & Gutenkauf

[57] ABSTRACT

An apparatus adapted for vehicle frame and chassis repair having a vehicle bed with horizontal portions for fixedly anchoring a damaged vehicle preparatory to repair and particularly straightening of the vehicle. The bed tilts toward the ground for mounting and removal of the vehicle. A plurality of pull tower assemblies are movably mounted with respect to the bed. Each pull tower assembly includes an upright tower column and a pivot arm connected to the bed. A power head assembly rotatably mounted on the top of the column includes a frame and a hydraulic actuator with a first portion fixed to the frame and a second portion horizontally movable with respect to the frame. A flexible tension member has a first end connected to the frame and a second end connectable to the vehicle at a remote location for exertion of a pulling force. A portion of the flexible tension member is trained over guide means connected to the second portion of the hydraulic actuator whereby movement of the second portion of the hydraulic actuator causes a pull to be exerted on the flexible tension element and transmitted to the vehicle. The pull tower column is mounted on the movable end of the pivot arm. The fixed end of the pivot arm is pivotally assembled to a tower pivot mount secured to the bed assembly. Means are provided for locking the tower pivot arm in place with respect to the bed assembly.

22 Claims, 9 Drawing Figures

FIG. 7
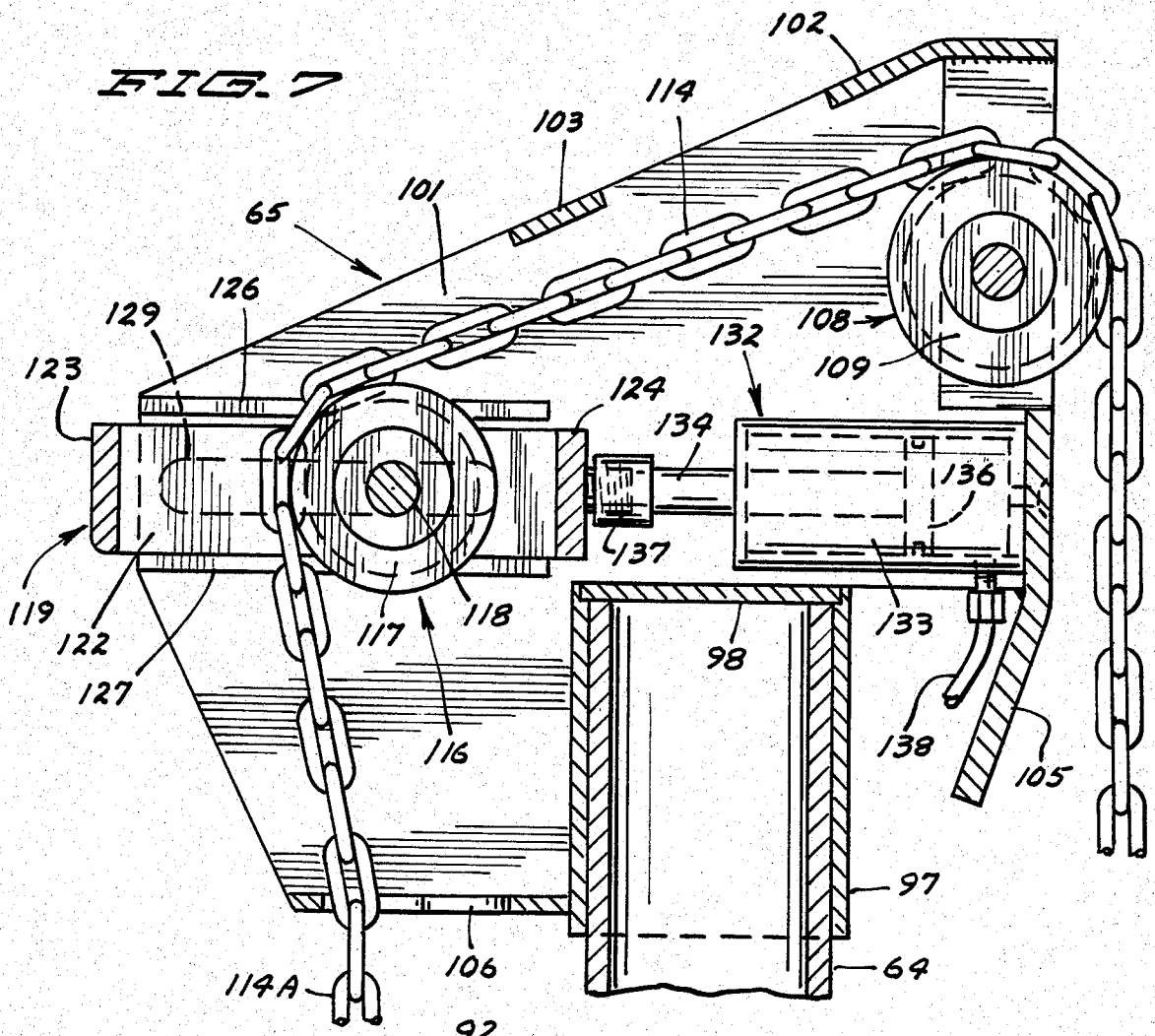
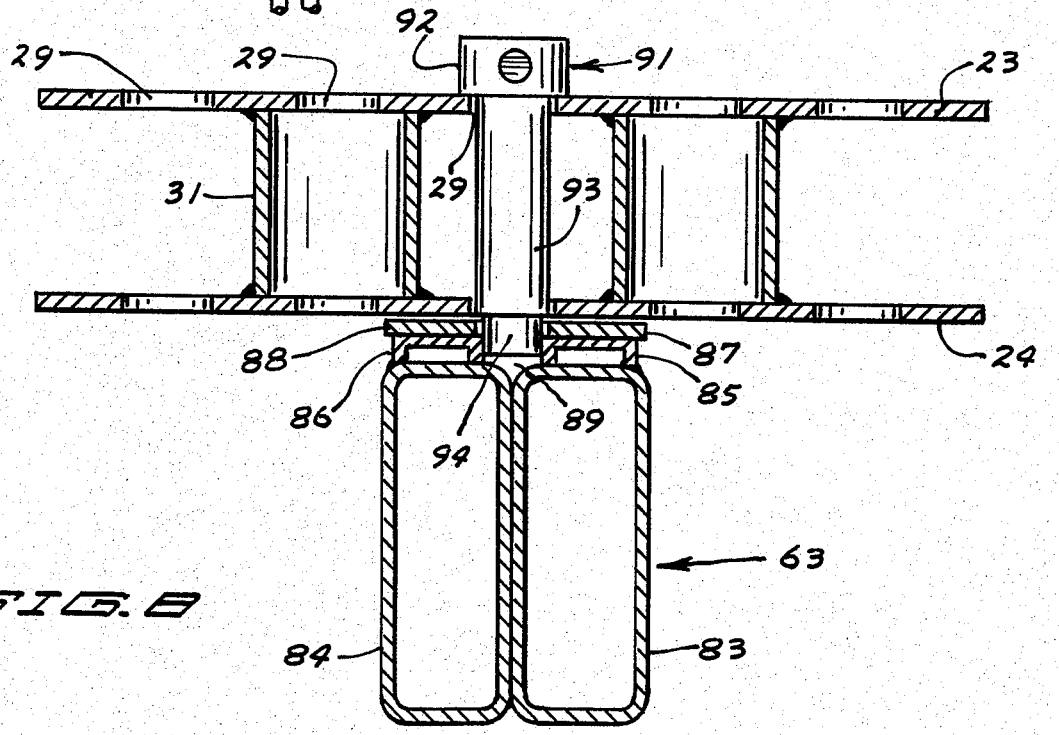
FIG. 8

FRAME AND BODY REPAIR APPARATUS

SUMMARY OF THE INVENTION

Automotive and other vehicle body repair is a labor intensive activity causing even seemingly minor damage to be unduly expensive to repair. Accordingly, any machinery which increases the efficiency of the repair effort is desirable. An example of such apparatus is a frame and body straightening machine having a platform or bed for support of the damaged vehicle. With the vehicle attached to the bed, a generally horizontal pull is exerted at the damaged chassis or frame area. Numerous devices are provided in the prior art for exerting such a pull. A pull force can be provided by a hydraulic actuator connected by a tension line to the vehicle and fixed in position with respect to the bed and the vehicle. Extension or retraction of the movable portion of the hydraulic actuator results in a pulling force being exerted on the tension element to pull the damaged portion of the vehicle toward the original shape.

The present invention comprises an apparatus of the type described having a vehicle bed with horizontal portions for fixedly anchoring a damaged vehicle preparatory to repair and particularly straightening of the vehicle. Means are provided for tilting the bed toward the ground for mounting and removal of the vehicle. A plurality of pull tower assemblies are movably mounted with respect to the bed. Each pull tower assembly includes an upright tower column and a pivot arm connected to the bed. A power head assembly rotatably mounted on the top of the column includes a frame and a hydraulic actuator with a first portion fixed to the frame and a second portion horizontally movable with respect to the frame. A flexible tension member has a first end connected to the frame and a second end connectable to the vehicle at a remote location for exertion of a pulling force. A portion of the flexible tension member is trained over guide means connected to the second portion of the hydraulic actuator whereby movement of the second portion of the hydraulic actuator causes a pull to be exerted on the flexible tension element and transmitted to the vehicle.

The pull tower column is mounted on the movable end of the pivot arm. The fixed end of the pivot arm is pivotally assembled to a tower pivot mount secured to the bed assembly. Means are provided for locking the tower pivot arm in place with respect to the bed assembly.

IN THE DRAWINGS

FIG. 1 is a side elevational view of a frame and body repair apparatus according to the invention with a vehicle installed thereon shown in broken lines;

FIG. 7 is an enlarged sectional view of the power head assembly as shown in FIG. 5 taken along the line 7—7 thereof;

DESCRIPTION OF A PREFERRED EMBODIMENT

Figure 2:
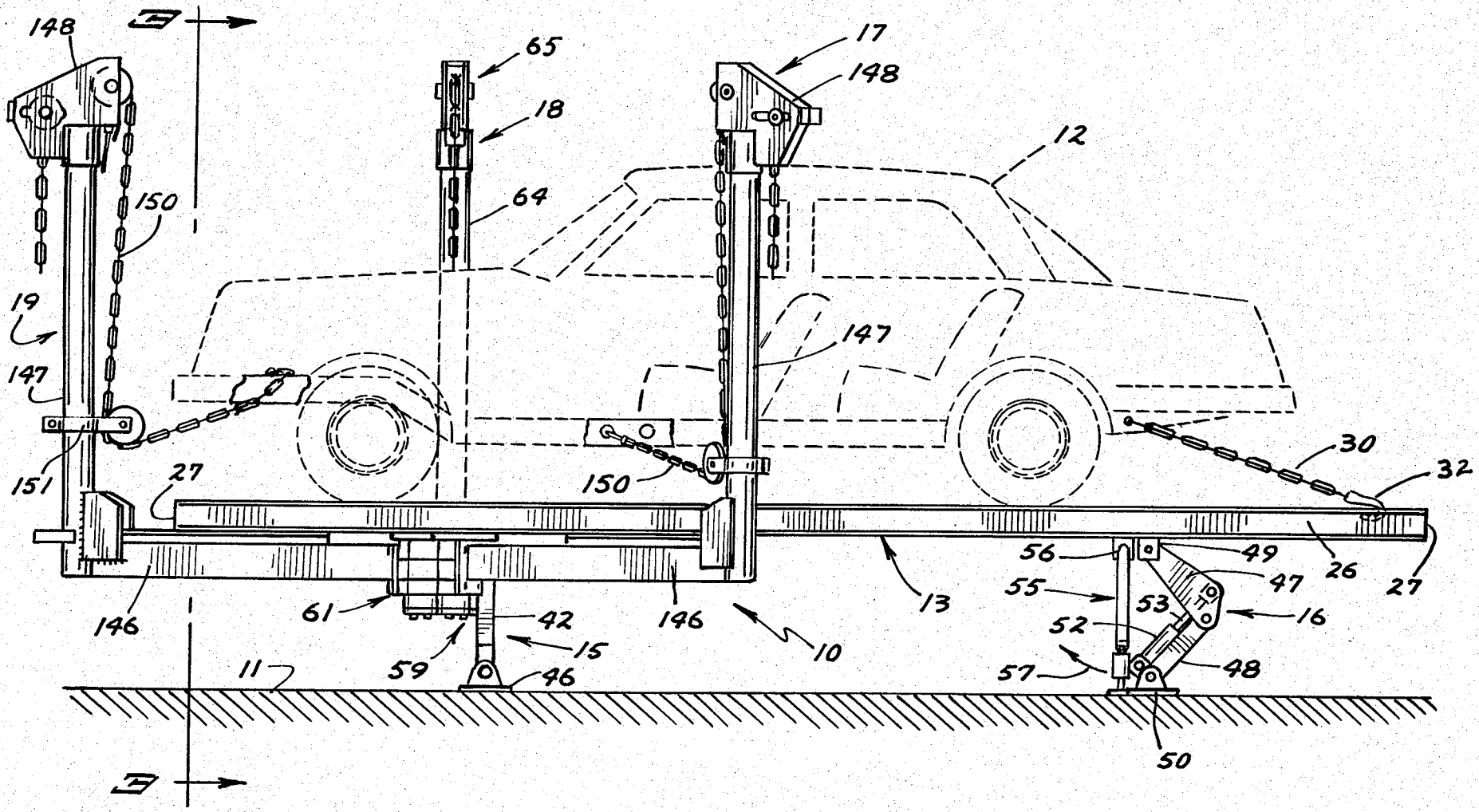
FIG. 2 is a top plan view of the frame and body repair apparatus of FIG. 1 with portions of the vehicle shown in broken lines.

Referring to the drawings, there is shown in FIGS. 1 and 2 a frame and body repair apparatus 10 of one form of the invention installed on the service floor 11 of an appropriate service building, such as a repair garage. A vehicle 12 indicated in phantom in FIG. 1 rests on bed 13 of repair apparatus 10. Bed 13 is supported in generally horizontal orientation above the floor 11 by a main tilt bed pivot assembly 15 at one end and a safety stand and scissor lift assembly 16 toward the other. Bed 13 is pivotal about a horizontal axis with respect to tilt bed pivot assembly 15. Pull tower assemblies 17, 18, and 19 are pivotally assembled with respect to bed 13 for operating on vehicle 12 during repair procedures.

Bed 13 includes a pair of parallel, spaced apart box-like tread assemblies 22A, 22B. Each tread assembly includes a relatively wide upper tread plate 23 and a corresponding parallel lower tread plate 24. The upper and lower tread plates are connected by channel-shaped side tread beams 26 along the side edges thereof, and by end tread closures 27 at the front and rear ends. Upper and lower tread plates 23 A,B have a plurality of regularly spaced fastening holes 29. Fastening holes 29 are useful for purposes such as securing hook ends 31 of tie-down chains like the tie-down chain 30 shown in FIG. 1. A plurality of cylindrical spacers 31 are provided between the upper and lower tread plates 23, 24 for support between the side tread beams 26. Spacers 31 are preferably aligned with fastening holes 29 (see FIG. 8). Front and rear tie bars 33, 34 extend respectively between the front and rear ends of the tread assemblies 22A, 22B. The front and rear tie bars preferably also have spaced apart fastening holes. The various tread plates, tread beams, tie bars and the like are rigidly fastened by suitable means, such as welding.

An intermediate forward tie plate assembly is spaced rearwardly of forward tie bar 33 and includes upper and lower tie plates 36, 37 extended between the interior side tread beams 26. An intermediate rearward tie beam assembly spaced forward of the rear tie bar 34 includes first and second transverse, box-like tie beams 39, 40 disposed in adjacent relationship. One of the tie beams 40 extends inward of the tread assemblies 22A, 22B for purposes of additional rigidity.

Tilt bed pivot assembly 15 includes a transverse main tilt bed pivot leg 42 secured at its upper end to the lower surface of lower tie plate 37. Tilt bed leg 42 is sturdy in construction to support bed 13 and can be box-like in cross-sectional configuration. A horizontal transverse pivot beam 43 is secured to the lower end of pivot leg 42. Pivot bars 44 extend outwardly from the outer ends of the pivot beam 43. A pair of pivot brackets 46 are secured to the floor surface 11 and have openings for receipt of the outwardly extended ends of the pivot bars 44. The pivot bars 44 are pivotally mounted in the pivot brackets 46.

The rearward end of bed 13 is supported by safety stand and scissor lift assembly 16. A scissor lift mechanism includes a first or upper scissor arm 47 pivotally connected to a second or lower scissor arm 48. The opposite end of first scissor arm 47 is connected to a lug 49 fixed to the lower surface of transverse tie beams 39, 40. The opposite and lower end of the second scissor arm 48 is pivotally connected to a lug 50 fixed to the ground surface 11. A hydraulic actuator 52 is pivotally connected to the lower end of second scissor leg 48. The extendible and retractable rod 53 of actuator 52 is connected at its outer end to an intermediate portion of the first scissors leg 47. A safety leg mechanism 55 is pivotally connected at its upper end to a lug 56 secured to the lower surfaces of transverse tie beams 39, 40. The lower end of safety leg mechanism 55 can be positioned in contact with ground surface 11 in a generally vertical orientation as shown. Safety leg mechanism 55 can be pivoted to an out-of-the-way position in the direction of the arrow 57. When the safety leg mechanism is pivoted in an out-of-the-way position, hydraulic actuator 52 is operable to extend and collapse the scissor arms 47, 48. Retraction of the rod 53 collapses the scissor arms 47, 48 to lower the end of bed 13 for loading and unloading of a vehicle. Extension of the rod 53 separates the ends of scissor arms 47, 48 to raise the rearward end of bed 13 to the generally horizontal orientation shown. When the bed is raised, safety leg mechanism 55 is put in place for purposes of security.

Figure 3:
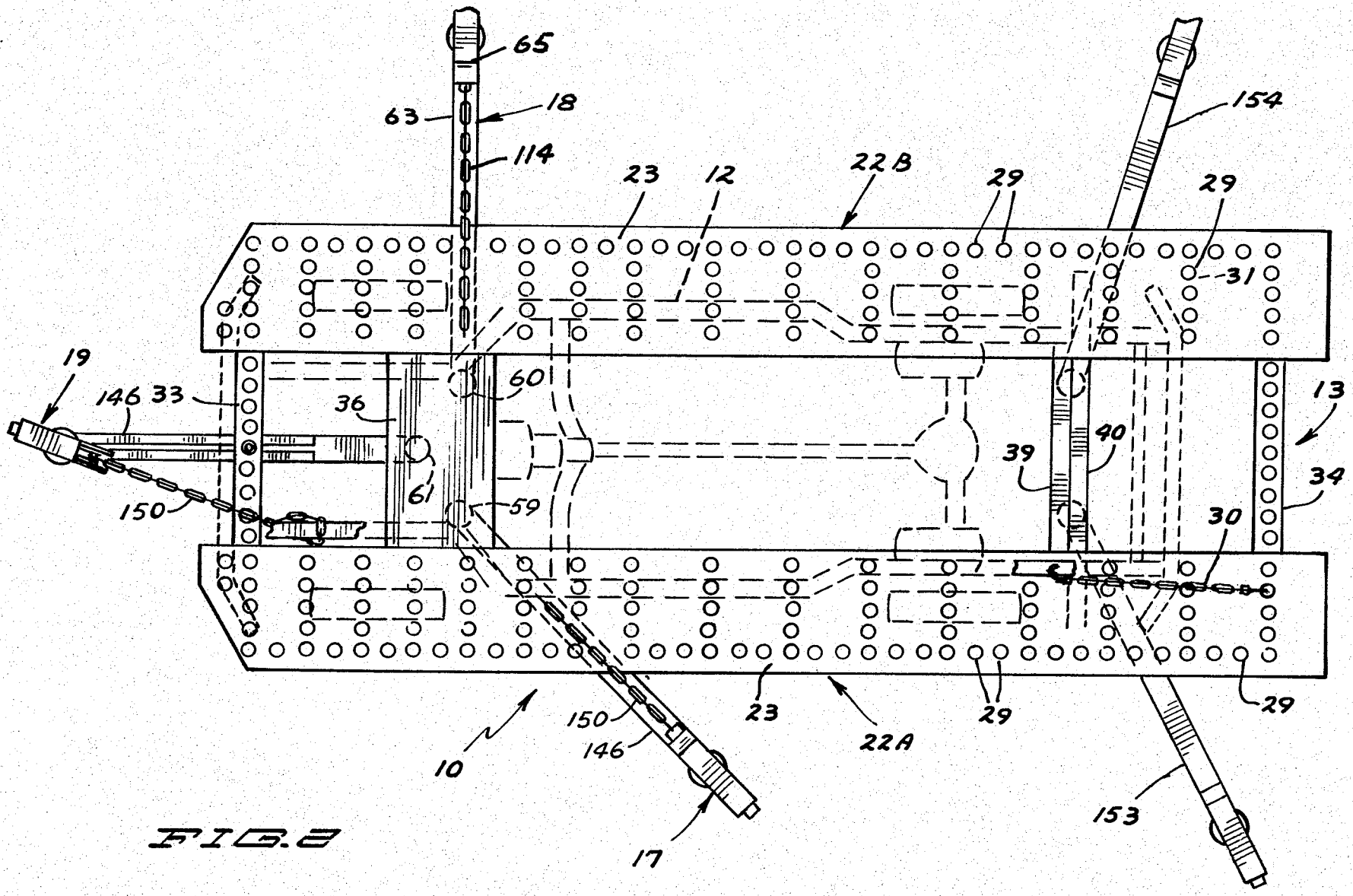
FIG. 3 is a front elevational view of the frame and body repair apparatus of FIG. 1 with portions shown in section and taken along the line 3—3 of FIG. 1.

Pull tower assemblies 17–19 are rotatably assembled to bed 13 by pull tower pivot assemblies 59–61 respectively for rotation about separate vertical axes. Pull tower assembly 18 is exemplary and, as shown in FIG. 3, includes pull tower pivot assembly 60 connected to lower tie plate 37. A fixed end of a pivot arm 63 is pivotally connected to pull tower pivot assembly 60. The free end of pivot arm 63 is connected to the lower end of pull tower column 64. A power head assembly 65 is rotatably assembled to the upper end of pull tower column 64.

Figures 8, 9:
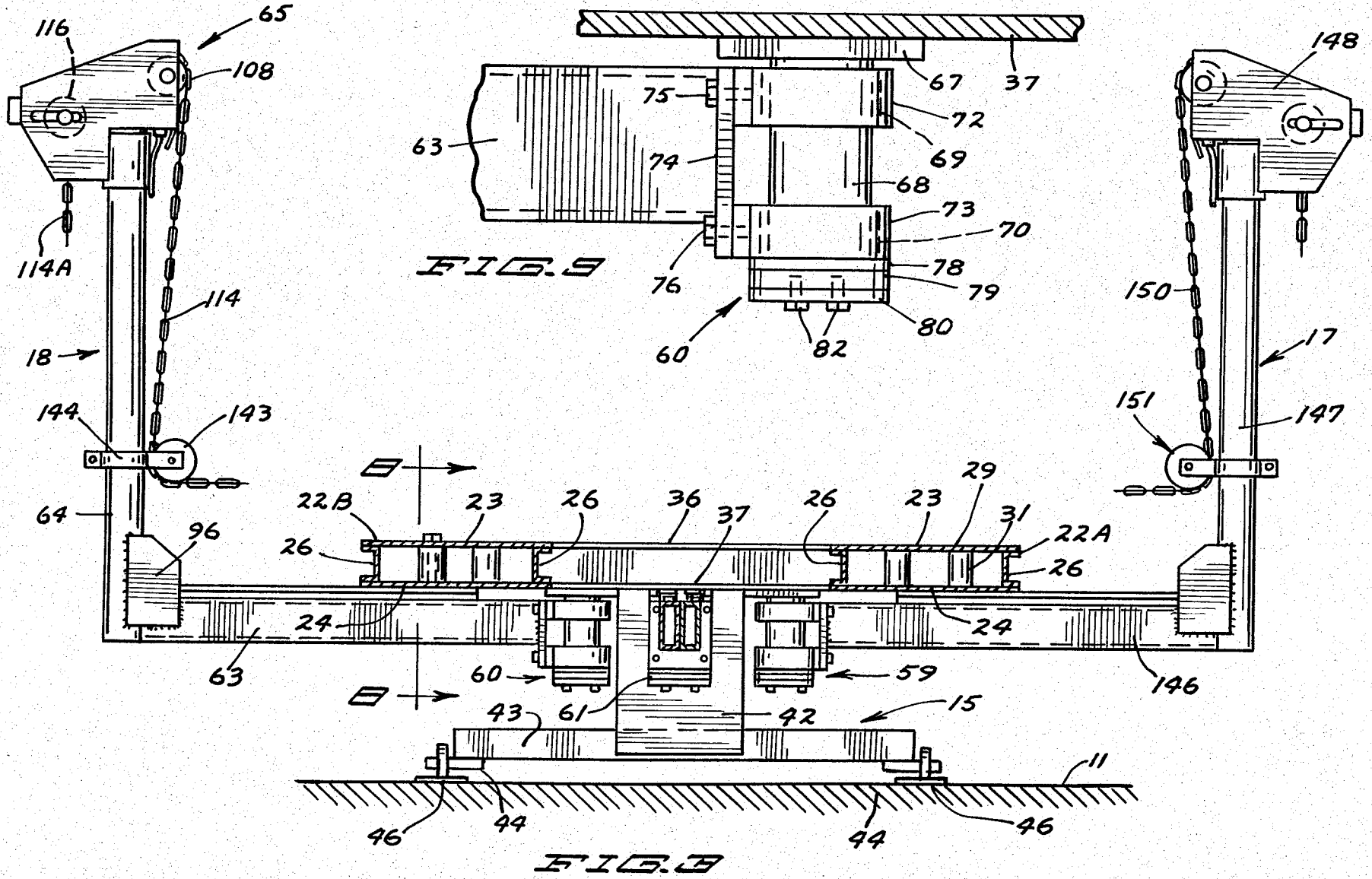
FIG. 8 is an enlarged sectional view of a portion of the frame and body repair apparatus of FIG. 3 taken along the line 8—8 thereof.
FIG. 9 is an enlarged view of one of the tower assembly pivot mounts of FIG. 3.
Figure 6:
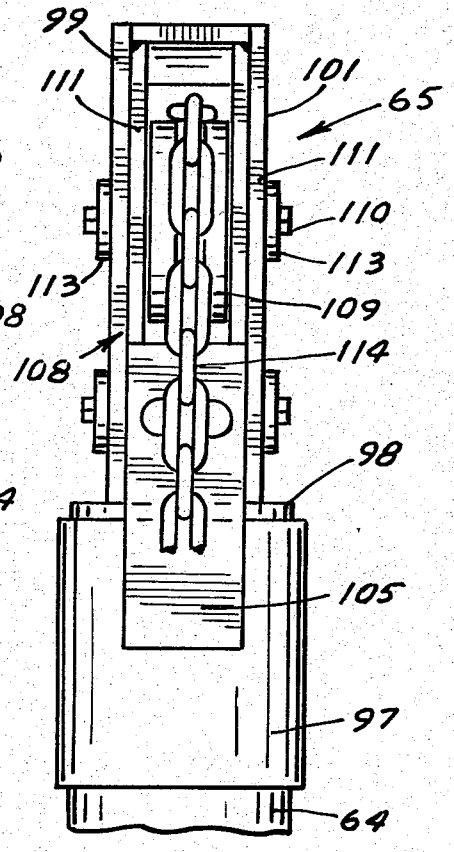
FIG. 6 is an end elevational view of the power head assembly of FIG. 4.
Figure 4:
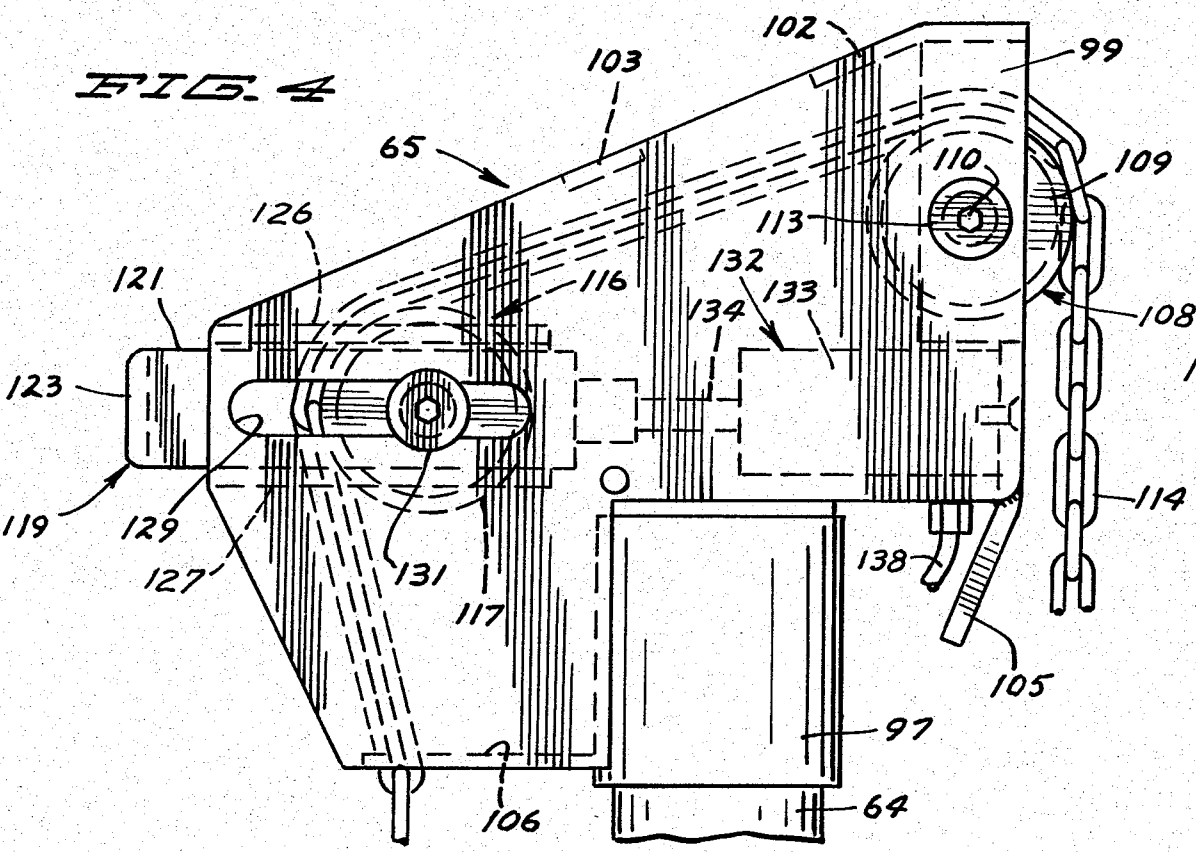
FIG. 4 is an enlarged side elevational view of a power head assembly of one of the pull tower assemblies of FIG. 1.
Figure 5:
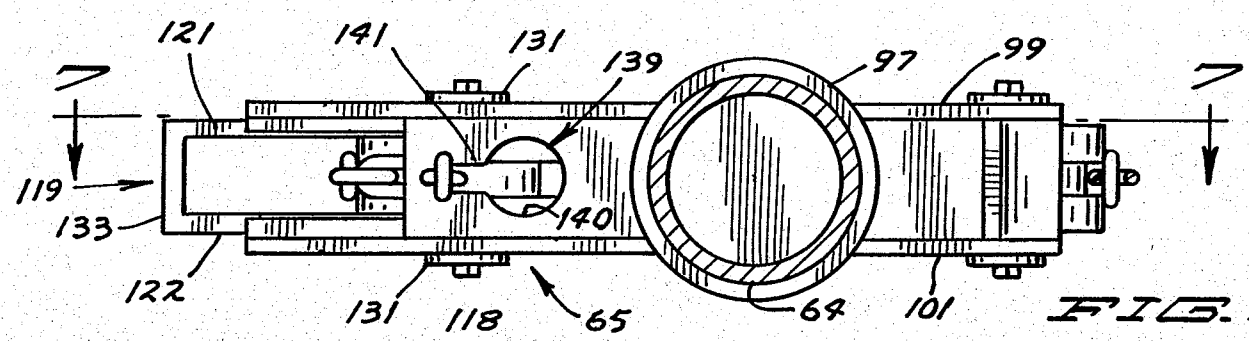
FIG. 5 is a bottom plan view of the power head assembly of FIG. 4.

Pull tower pivot assembly 60 is more particularly shown in FIG. 9. A pull tower pivot plate 67 is secured to the lower surface of lower tie plate 37 by suitable means, such as welding. A cylindrical pull tower pivot bar 68 extends downwardly from plate 67. Upper and lower support bearings 69, 70 surround the pull tower pivot bar 68. Upper and lower tower support castings 72, 73 enclose the upper and lower bearings 69, 70. A vertical end plate 74 is secured to the end of horizontal pivot arm 63 and is fastened to the upper and lower support castings 72, 73 by bolts 75, 76 on one side of plate 74, and similarly disposed bolts (not shown) on the opposite side. Lower support bearing 70 and lower casing 73 rest on a thrust bearing 78 encircling tower pivot bar 68. Thrust bearing 78 rests on thrust plate 79, which is held in place by thrust plate retainer 80. Thrust plate retainer 80 is secured to the lower end of tower pivot bar 68 by bolts 82. Horizontal pivot arm 63 is thus rotatable about an axis coincidental with the axis of pivot bar 68.

As shown in FIG. 2, pivot arm 63 is rotatable about pivot bar 68 to correctly position pull tower assembly 18 with respect to a vehicle located on bed 13 for performance of repair work. An inward portion of pivot arm 63 is continually disposed beneath bed 13. Means are provided on pivot arm 63 for locking the position of tower assembly 18 with respect to bed 13. As shown in FIG. 8, pivot arm 63 is comprised of a pair of parallel side-by-side, box-like beams 83, 84 fastened together in adjacent relationship. Inverted parallel, spaced apart channel members 85, 86 extend along a portion of the length of beams 83, 84 located beneath the bed 13. Each inverted channel member 86, 87 carries an elongate flat strap 87, 88, also being spaced apart and forming a locking channel 89. Channel 89 is positionable to have a portion located beneath a set of locking holes 29 in bed 13. A locking pin 91 has an upper head 92 and a shank 93 with a lower reduced portion 94. The shank 93 is insertable through one of the locking holes 29 poised over channel 89. Head 92 is intercepted by the edges of the upper hole 29. The lower reduced portion 94 extends through the lower locking hole 29 into the channel 89 to prohibit rotational movement of the pivot arm 63. Removal of the pin 91 permits rotational movement to another location. Pivot arm 63 is locked in another position simply by positioning the channel 89 beneath another pair of locking holes 29 and inserting the locking pin 91.

The lower end of pivot tower column 64 is connected to the outer end of pivot arm 63 and can be reinforced by a suitable corner brace member 96. The upper end of column 64 rotatably supports power head assembly 65 at an elevation proximate to or above the height of a typical vehicle to be repaired when supported on bed 13. Referring to FIGS. 4 through 7, power head assembly 65 has a downwardly open tubular mounting sleeve 97 with a closed upper end plate 98. Sleeve 97 telescopically engages the upper end of column 64 and is rotatable with respect to column 64. Vertical side plates 99, 101 are fixed to sleeve 97 in parallel, spaced apart relationship. Upper and intermediate bridge plates 102, 103 are fixed between and rigidly connect side plates 99, 101. Likewise, a cylinder mount plate 105 is fixed between side plates 99, 101 spanning a lower portion adjacent forward edges thereof. A downwardly facing chain grip plate 106 is fixed between the side plates 99, 101 along lower edges thereof rearward of mounting sleeve 97.

A first or stationary chain pulley 108 is rotatably mounted between side plates 99, 101 at a location adjacent forward edges thereof above cylinder mount plate 105. Pulley 108 has a pulley sheave 109 rotatably mounted on an axle 110 passing through aligned openings in side plates 99, 101 and reinforcing plates 111 secured adjacent the inside surfaces of the side plates. Fasteners 113 secure the outer ends of axle 110. Pulley sheave 109 carries a portion of a flexible tension line or pull chain 114. A second or movable chain pulley 116 has a pulley sheave 117 rotatably mounted on an axle 118, which is securely fastened to a pulley frame 119. Pulley frame 119 has vertical side walls 121, 122, vertical end walls 123, 124, and is open at the top and bottom. Pairs of upper and lower horizontal guide bars 126, 127 (FIG. 7) are fixed to the inside surfaces of side plates 99, 101 and constrain pulley frame 119 for movement in a horizontal direction. Pulley axle 118 is fixed to the side walls 121, 122 of pulley frame 119 and extends outward therefrom. Horizontal slots 129 are formed in the side walls 99, 101. The ends of axle 118 extend outward of the horizontal slots 129 and are secured by fasteners 131. Slots 129 limit horizontal movement of pulley frame 119.

A linear hydraulic actuator 132 is horizontally disposed between side plates 99, 101 and has a cylinder end 133 fixed to cylinder mount plate 105. A rod 134 extends outwardly from cylinder 133 and is connected at an inner end to a piston 136 reciprocally located in cylinder 133. The outer end of rod 134 is fixed by fitting 137 to pulley frame 119. Selective reciprocation of rod 134 results in reciprocation of pulley frame 119 along with pulley 116. Hydraulic fitting 138 is connected to cylinder 133 at one end and to suitable controls (not shown) at the other end for selective reciprocation of rod 134. Outward movement of rod 134 is effective to increase the length of chain trained between the pulleys 108, 116.

Pull chain 114 is trained over pulley 108 and pulley 116. Chain 114 extends to a fixed end from pulley 116. Chain grip plate 106 has a key slot 139 (see FIG. 5) having an enlarged portion 140 and a restricted portion 141. Enlarged portion 140 is large enough to permit passage of links of pull chain 114, and restricted portion 141 is narrower than the width of a link of chain 114. Chain 114 is inserted in slot 139 through the enlarged portion 140 and then moved to the restricted portion 141 where it is locked in place providing the fixed end 114A for chain 114. Outward movement of rod 134 to increase the length of chain trained between the pulleys 108, 116 results in a pull exerted on the opposite end of chain 114.

As shown in FIG. 3, the other end of chain 114 extending from pulley 108 extends downwardly to an idler pulley 143 mounted on a vertically adjustable idler pulley bracket 144 secured to the column 64. Chain 114 extends from idler pulley 143 to a connection point with the vehicle being repaired. Power head 65 is rotatably mounted on column 64 so as to be self-aligning with respect to chain 114 regardless of the position of pivot arm 63.

First and third tower assemblies 17, 19 are constructed in like fashion to second tower assembly 18. Each has a pivot arm 146 connected to a tower column 147, a power head 148 connected to a pull chain 150, which extends to an idler pulley bracket assembly 151 mounted on the column 147, and then to the vehicle to be repaired. Additional tower assemblies could be provided mounted on bed 13, for example, tower assemblies 152, 153 shown in FIG. 2 mounted with respect to tie beams 39, 40. One or more pulley towers are used at a time as needed.

In use of repair apparatus 10, bed 13 is lowered at scissors lift assembly 16 and vehicle 12 is loaded thereon. Scissors lift 16 is elevated and safety leg mechanism 55 is put in place. One or more tie-down chains 30 are put in place being fastened at hook end 32 to mounting holes 23 and at the other end to vehicle 12. The pull tower assemblies are rotated to the proper orientation with respect to vehicle 12 about pivots 59, 60, 61. One or more pull towers can be used. At the proper location, locking pins are inserted through bed 13 to lock the pivot arms in place. Pull chains 114, 115 are fastened to the vehicle 12 at selected locations on the frame or body that require repair. In each power head, the rod 134 is initially retracted relative to the cylinder 133 and the end of the pull chain is fixed in chain grip plate 106. As hydraulic actuator 132 is actuated to extend the rod 134, pulley block 123 carrying the movable pulley 17 is moved along slot 129 resulting in a pull on the pull chain 114, which is transmitted to the vehicle 12. From time to time as needed, slack in the chain is adjusted by repositioning the chain with respect to chain lock plate 106. Upon completion of the pulling procedure, tension in the power heads is relieved and the vehicle is unloaded from bed 13 for completion of repairs.

While there has been shown and described a certain preferred embodiment of the invention, it is apparent that certain deviations can be had without departing from the scope and spirit of the invention.

The embodiments of the invention in which an exclusive property or privilege is claimed are defined as follows:

1. A vehicle body repair apparatus comprising:

a bed having a horizontally orientated portion for support of a vehicle to be repaired;

a pull tower assembly having an upright pull tower column and a horizontal pivot arm, a first end of the pivot arm being pivotally connected to the bed for rotation about an upright axis, a second end of the pivot arm being connected to the lower end of the tower column for rotational movement of the tower column with respect to the bed;

pivot means pivotally assembling the first end of the pivot arm to the bed;

means for securing a vehicle to the bed;

a power head assembled to the upper end of the tower column, said power head having a frame, a stationary pulley means assembled to the power head frame, a movable pulley means assembled to the power head frame, guide means on the power head frame for guiding the movable pulley means in a horizontal path between first and second positions with respect to the stationary pulley means;

a tension line having a first end releasably fixed with respect to the power head frame, said tension line being trained over the first and second pulley means and having a second end fixable relative to a vehicle to be repaired;

power means for the horizontal movement of the movable pulley means toward a position with respect to the stationary pulley means to exert a pull force on the tension line between the first and second pulley means when the second end of the tension line is fixed.

2. The repair apparatus of claim 1 including: a sleeve fixed to the power head frame, said sleeve being in telescopic engagement with the top end of the tower column.

3. The repair apparatus of claim 1 wherein: said tension line is comprised as a pull chain, said power head frame having a pull chain lock plate, said pull chain lock plate having a key-shaped opening with a major portion permitting passage of chain links and a minor restricted portion connected to the major portion and having a transverse dimension to prohibit passage of a chain link.

4. The repair apparatus of claim 1 wherein: the power means for horizontal movement of the movable pulley means comprises a hydraulic actuator.

5. The repair apparatus of claim 4 wherein: said hydraulic actuator has a cylinder portion mounted to the power head frame and a rod reciprocally movable in and out with respect to the cylinder portion, a pulley frame, said movable pulley means including a movable pulley rotatably mounted to the pulley frame, said guide means on the power head frame to guide horizontal movement of the pulley frame, an outward end of the rod of the hydraulic actuator being connected to the pulley frame for horizontal movement of the pulley frame upon reciprocation of the rod of the hydraulic actuator.

6. The repair apparatus of claim 5 wherein: said power head frame includes first and second spaced apart side plates, said stationary pulley means including a stationary pulley rotatably mounted between said side plates at a forward portion thereof, said pulley frame being mounted between said side plates beneath and rearward of the stationary pulley, said hydraulic actuator being mounted toward a forward portion of the side plates with said rod extendible rearwardly thereof and being connected to the movable pulley frame.

7. The repair apparatus of claim 1 wherein: said bed includes first and second horizontal tread assemblies having regularly spaced apart locking holes extended therethrough; said pivot arm having a portion normally disposed beneath the tread assemblies; lock means on said pivot arm comprised as first and second parallel spaced apart members disposed on the top of said pivot arm forming a locking channel between them, and a locking pin selectively insertable through locking holes in the tread assemblies with a lower end locatable in the channel between the spaced apart members on the pivot arm.

8. The repair apparatus of claim 7 wherein: said pivot means to pivotally connect the first end of the pivot arm to the bed includes a pull tower pivot plate secured to a lower surface of the bed, a cylindrical pull tower pivot bar extending downwardly from the plate, upper and lower support bearings surrounding the pull tower pivot bar, upper and lower support casings enclosing the upper and lower support bearings and fixed to the pivot arm, a thrust bearing encircling the tower pivot bar beneath the lower support bearing, and a thrust plate secured to the lower portion of the pull tower pivot bar to support the thrust bearing and upper and lower support casings.

9. The repair apparatus of claim 7 wherein: said bed is supported at a forward portion by a tilt bed pivot assembly for tilting about a horizontal axis for loading and unloading of vehicles, said tilt bed pivot assembly including a transverse main tilt bed pivot leg secured at an upper end to a lower surface of the bed, a transverse pivot beam secured to the lower end of the pivot leg, a pair of pivot bars extended outwardly from outer ends of the transverse pivot beam, a pair of pivot brackets secured to the repair apparatus mounting surface, said pivot bars extended through openings of the pivot brackets for pivotal movement of the main tilt bed pivot leg.

10. The repair apparatus of claim 9 wherein: said bed includes upper and lower forward transverse tie plates extended between the first and second horizontal tread assemblies, said pull tower assembly comprising a first pull tower assembly, and including second and third pull tower assemblies, each having a first end of a pivot arm pivotally connected to the bed for rotation about an upright axis, a second end of the pivot arm connected to the lower end of a tower column for rotational movement of the tower column with respect to the bed, pivot means pivotally assembling the first end of the pivot arms to the bed, a power head assembly assembled to the upper end of the tower column, said power head assembly having a power head frame, a stationary pulley means assembled to the power head frame, a movable pulley means assembled to the power head frame, guide means on the power head frame for guiding the movable pulley means in a horizontal path between first and second positions with respect to the stationary pulley means, a tension line having a first end fixed with respect to the power head frame, said tension line being trained over the first and second pulley means and having a second end fixable to a vehicle to be repaired, means for the horizontal movement of the movable pulley means in a direction with respect to the stationary pulley means to exert a pull force on the tension line between the first and second pulley means when the second end of the tension line is fixed; said pivot means pivotally assembling the first end of the pivot arms of the first, second, and third pivot tower assemblies being spaced apart for rotation about separate vertical axes.

11. The repair apparatus of claim 10 wherein: each said pivot means of the first, second, and third pull tower assemblies to connect the first end of the pivot arms to the bed includes a pull tower pivot plate secured to a lower surface of the bed, a cylindrical pull tower pivot bar extending downwardly from the plate, upper and lower support bearings surrounding the pull tower pivot bar, upper and lower support casings enclosing the upper and lower support bearings and fixed to the pivot arm, a thrust bearing encircling the tower pivot bar beneath the lower support bearing, and a thrust plate secured to the lower portion of the pull tower pivot bar to support the thrust bearing and upper and lower support casings.

12. The repair apparatus of claim 11 wherein: the means for horizontal movement of the movable pulley means of the first, second, and third pull tower assemblies in a direction with respect to the stationary pulley means comprises a hydraulic actuator.

13. The repair apparatus of claim 11 including: idler pulleys connected to each tower column, a portion of each corresponding tension line being trained over each idler pulley.

14. A pull tower assembly for exerting a pull in a repair effort of damaged apparatus, comprising:

an upright pull tower column;

a power head assembly mounted on the column and having a power head frame;

stationary pulley means mounted on the power head frame;

movable pulley means assembled to the power head frame for horizontal movement relative to the power head frame between first and second positions with respect to the stationary pulley means;

guide means on the power head frame for guiding horizontal movement of the movable pulley means;

a tension line having a first end fixed with respect to the power head frame, and a second end extendible to apparatus under repair;

said tension line being trained over the stationary and movable pulley means between the first and second ends;

power means for horizontal movement of the movable pulley means from one position toward the other position with respect to the stationary pulley means to exert a pull force on the tension line between the first and second pulley means when the second end of the tension line is fixed.

15. The pull tower assembly of claim 14 wherein: the power means for horizontal movement of the movable pulley means comprises a hydraulic actuator.

16. The pull tower assembly of claim 15 wherein: said hydraulic actuator has a cylinder portion mounted to the power head frame and a rod reciprocally movable in and out with respect to the cylinder portion, a pulley frame, said movable pulley means included a movable pulley rotatably mounted to the pulley frame, said guide means on the power head frame to guide horizontal movement of the pulley frame, an outward end of the rod of the hydraulic actuator being connected to the pulley frame for horizontal movement of the pulley frame upon reciprocation of the rod of the hydraulic actuator.

17. The pull tower assembly of claim 14 wherein: said tension line is comprised as a pull chain, said power head frame having a pull chain lock plate to releasably fix the first end of the pull chain, said pull chain lock plate having a key-shaped opening with a major portion to permit passage of chain links and a minor restricted portion connected to the major portion having a transverse dimension to prohibit passage of a chain link.

18. The pull tower assembly of claim 17 including: a sleeve fixed to the power head frame, said sleeve being in telescopic engagement with the top end of the tower column and rotatable with respect to the top end of the tower column about an upright axis.

19. The pull tower assembly of claim 18 including: an idler pulley connected to the pull tower column, said second end of the pull chain being trained over the idler pulley.

20. A power head for providing a pull force on a tension line, comprising:

first and second parallel, spaced apart generally upright side plates;

means connecting the side plates in generally parallel, spaced apart relationship;

a stationary pulley mounted between the side plates for rotation about a horizontal axis perpendicular to the plane of the side plates;

a movable pulley mounted on a movable pulley axle for rotation about an axis parallel to the axis of rotation of the stationary pulley;

said movable pulley being mounted to a movable pulley frame;

guide means on the side plates for horizontal movement of the movable pulley frame with respect to the side plates between a first position and a second position relative to the stationary pulley;

a tension line having a first end releasably fixed with respect to the side plates, a second end extendible away from the side plates for fixation to a remote structure, and an intermediate portion trained over the stationary pulley and the movable pulley;

power means having a first portion fixably assembled with respect to the side plates and a second portion movable with respect to the first portion, said second portion connected to the pulley frame to move the pulley frame from one position toward the other position in a direction to exert a pull force on the tension line between the movable and stationary pulleys when the second end of the tension line is fixed.

21. The power head of claim 20 wherein: said power means includes a hydraulic actuator having a cylinder portion fixed with respect to the first and second side plates, and an extendible and retractable rod portion having an outward end connected to the pulley frame; said guide means on the side plates including pairs of horizontal upper and lower guide rails fastened to the side plates and positioned to support the pulley frame for horizontal movement.

22. The power head of claim 21 wherein: said tension line is comprised as a pull chain, a pull chain lock plate disposed between the side plates to releasably fix the first end of the pull chain, said lock plate having a key-shaped opening with a major portion to permit passage of chain links and a minor restricted portion connected to the major portion having a transverse dimension to prohibit passage of a chain link.

* * * * *